US009850887B2

(12) United States Patent
Yamamoto et al.

(10) Patent No.: US 9,850,887 B2
(45) Date of Patent: Dec. 26, 2017

(54) SWASH PLATE TYPE VARIABLE DISPLACEMENT COMPRESSOR

(71) Applicant: KABUSHIKI KAISHA TOYOTA JIDOSHOKKI, Aichi-ken (JP)

(72) Inventors: Shinya Yamamoto, Aichi-ken (JP); Hiromichi Ogawa, Aichi-ken (JP); Kei Nishii, Aichi-ken (JP); Shohei Fujiwara, Aichi-ken (JP)

(73) Assignee: KABUSHIKI KAISHA TOYOTA JIDOSHOKKI, Aichi-Ken (JP)

( * ) Notice: Subject to any disclaimer, the term of this patent is extended or adjusted under 35 U.S.C. 154(b) by 273 days.

(21) Appl. No.: 14/800,075

(22) Filed: Jul. 15, 2015

(65) Prior Publication Data

US 2016/0025084 A1 Jan. 28, 2016

(30) Foreign Application Priority Data

Jul. 22, 2014 (JP) ..... 2014-148538

(51) Int. Cl.
*F04B 1/26* (2006.01)
*F04B 27/18* (2006.01)
(Continued)

(52) U.S. Cl.
CPC ..... *F04B 27/18* (2013.01); *F04B 27/0873* (2013.01); *F04B 27/1054* (2013.01)

(58) Field of Classification Search
CPC ..... F04B 27/1804; F04B 27/1063; F04B 27/0878; F04B 27/12; F04B 27/1036; F04B 27/1054; F04B 27/1072; F04B 39/0027; F04B 39/10; F04B 39/123; F04B 39/121; F01B 3/0026
(Continued)

(56) References Cited

U.S. PATENT DOCUMENTS 536,410 A * 3/1895 Winchell ..... F16C 33/74 241/144
906,197 A * 12/1908 Byrnes ..... D01H 7/042 384/603
(Continued)

FOREIGN PATENT DOCUMENTS

JP 5-172052 7/1993

*Primary Examiner* — Charles Freay
(74) *Attorney, Agent, or Firm* — Greenblum & Bernstein, P.L.C.

(57) ABSTRACT

A swash plate type variable displacement compressor includes a housing having therein a suction chamber, a discharge chamber a swash plate chamber and a cylinder bore. The compressor further includes a drive shaft, a swash plate and a link mechanism provided between the drive shaft and the swash plate. The compressor further includes a piston, a conversion mechanism, an actuator and a control mechanism. The actuator includes a partitioning member and a moving member, and a pressure control chamber formed therebetween. A support member is fitted on the drive shaft, and the contact of the support member with the moving member determines maximum inclination angle of the swash plate. A thrust bearing supports a thrust force. The support member includes a cylindrical portion that projects beyond the one end of the drive shaft. The position of the cylindrical portion is adjustable in the direction of the drive shaft.

3 Claims, 6 Drawing Sheets

(51) Int. Cl.
*F04B 27/10* (2006.01)
*F04B 27/08* (2006.01)

(58) Field of Classification Search
USPC ..... 417/365; 385/249, 616, 620
See application file for complete search history.

(56) References Cited

U.S. PATENT DOCUMENTS 1,819,715 A * 8/1931 Le Bret ..... F16H 23/02
123/56.4
3,450,058 A * 6/1969 Stein ..... F01B 3/0002
29/898.07
3,617,156 A * 11/1971 Schiele ..... F04D 13/0613
415/104
3,678,807 A * 7/1972 Papst ..... F01B 3/0026
74/60
4,037,993 A 7/1977 Roberts
4,106,192 A * 8/1978 Stahlecker ..... D01H 4/12
384/610
5,259,736 A 11/1993 Terauchi
5,842,834 A * 12/1998 Kawaguchi ..... F04B 27/1036
417/222.2
5,871,337 A * 2/1999 Fukanuma ..... F04B 39/1073
417/222.2

* cited by examiner

SWASH PLATE TYPE VARIABLE DISPLACEMENT COMPRESSOR

BACKGROUND OF THE INVENTION

The present invention relates to a swash plate type variable displacement compressor.

Japanese Patent Application Publication No. H05-172052 discloses a conventional swash plate type variable displacement compressor (hereinafter referred to as compressor). The compressor has a housing including a front housing, a cylinder block and a rear housing. The housing has therein a suction chamber, a discharge chamber, a swash plate chamber and a plurality of cylinder bores, and a drive shaft is rotatably supported in the housing. The swash plate chamber has therein a swash plate that is supported on the drive shaft for rotation therewith. A link mechanism is provided between the drive shaft and the swash plate that permits changing of the inclination angle of the swash plate, that is, an angle of the swash plate relative to an imaginary plane extending perpendicularly to the axis of the drive shaft. A piston is reciprocally slidably received in each cylinder bore. Each piston has a pair of shoes that functions as part of a conversion mechanism converting the rotation of swash plate into reciprocating motion of the piston in the cylinder bore with a length of stroke that is determined by the inclination angle of the swash plate. The compressor further has an actuator that can change the inclination angle of the swash plate by changing the volume of a control pressure chamber formed in the actuator, and a control mechanism that controls the actuator.

The drive shaft has mounted thereon a first connecting member, a second connecting member, a thrust bearing and a moving member which are disposed in this order as seen toward the rear of the compressor. The first connecting member and the second connecting member cooperate to form a link mechanism. Although it is not clear from the above-cited Publication, it is thought that the contact between the first connecting member and the swash plate determines the maximum inclination angle of the swash plate. The second connecting member is rotatable with the drive shaft and movable in the axial direction of the drive shaft. The moving member is not rotated with the drive shaft but movable in the axial direction of the drive shaft. A thrust bearing is provided between the second connecting member and the moving member to support the thrust force.

The actuator is disposed in the rear housing and has a pressure control chamber. Pressure in the pressure control chamber causes the moving member to move in the axial direction of the drive shaft. The cylinder block has on the rear side thereof an axial hole and the second connecting member, the thrust bearing and the actuator are accommodated in the axial hole. The moving member has in the outer peripheral surface thereof an O-ring which is in slide contact with the axial hole of the cylinder block.

When the pressure of refrigerant in the discharge chamber is introduced into the pressure control chamber by the control mechanism and the pressure in the control chamber is increased, the moving member pushes the second connecting member in the direction that increases the inclination angle of the swash plate. As a result, the discharge volume per rotation of the drive shaft, i.e. the displacement of the compressor, is increased. When no discharge pressure is introduced into the pressure control chamber of the actuator, on the other hand, the pressure in the pressure control chamber is gradually reduced and the moving member ceases to push the second connecting member, with the result that the inclination angle is decreased. Accordingly, the displacement of the compressor is reduced.

The compressor needs to be so configured that parts of the compressor are assembled with a thrust allowance in the axial direction, taking into account the ease and efficiency in the assembly in actual production of the compressor.

The cylinder bore of the above compressor includes first and second cylinder bores that are formed in a single cylinder block on the opposite sides thereof. In some compressors, the cylinder block may include a first cylinder block having therein the first cylinder bore and a second cylinder block having therein the second cylinder bore, and the first cylinder block and the second cylinder block cooperate to form therebetween a swash plate chamber. In the compressor having such first and second cylinder blocks, a first thrust bearing may be provided between the first cylinder block and the drive shaft so as to receive a first thrust force acting on the drive shaft in one direction when the cylinder blocks are fastened together for assembling and a second thrust bearing may be provided between the second cylinder block and the drive shaft so as to support a second thrust force acting on the drive shaft in the opposite direction when the cylinder blocks are fastened together.

The aforementioned thrust allowance is a dimensional difference between the total length of parts as measured in the axial direction of the drive shaft before assembling and a depth of the thrust in the compressor after assembly. The total length of the parts as measured in the axial direction before assembly corresponds to the sum of the thicknesses of the first thrust bearing, the thickness of the second thrust bearing and the length of the drive mechanism of the compressor as measured in the axial direction. The drive mechanism refers to a link mechanism and the actuator located between the first thrust bearing and the second thrust bearing. The depth of the thrust in the assembled compressor corresponds to the length between the outer end surface of the first thrust bearing and the outer end surface of the second thrust bearing.

If the thrust allowance becomes excessive, the compressor may have problems such as deformation of the first and second cylinder blocks, increased torque for driving the drive shaft and shortened life of the first and second thrust bearings. This may cause deterioration of product yield in mass production of the compressor. If the thrust allowance is controlled strictly, parts for the compressor need to be subject to strict dimension control, thus increasing the production cost of the compressor. Especially, in the compressor according to the present invention having a complex drive shaft mechanism between the first thrust bearing and the second thrust bearing, as compared with, for example, the double-headed piston type swash plate compressor disclosed in the above Publication, strict dimensional control is imposed on the parts of the compressor.

Furthermore, parts of the compressor need to be manufactured under strict dimensional control for the maximum inclination angle of the swash plate to be set accurately and uniformly, which increases the production cost of the compressor.

The present invention, which has been made in light of the above-mentioned problems, is directed to providing a swash plate type variable displacement compressor that permits reduction of the production cost of the compressor.

SUMMARY OF THE INVENTION

In accordance with an aspect of the present invention, there is provided a swash plate type variable displacement compressor including a housing having therein a suction chamber, a discharge chamber, a swash plate chamber and a plurality of cylinder bores. The swash plate type variable displacement compressor further includes a drive shaft, a swash plate and a link mechanism. The drive shaft is rotatably supported in the housing, and the swash plate is disposed in the swash plate chamber and rotatable with the drive shaft. The link mechanism is provided between the drive shaft and the swash plate and permits changing an inclination angle of the swash plate to an imaginary plane extending perpendicularly to the axis of drive shaft. The swash plate type variable displacement compressor further includes a piston, a conversion mechanism, an actuator and a control mechanism. The piston is reciprocally movably received in the cylinder bore, and the rotation of the swash plate is converted to a reciprocal motion of the piston by the conversion mechanism. The actuator is disposed in the swash plate chamber and changes the inclination angle of the swash plate under the control of the control mechanism. The actuator includes a partitioning member and a moving member, and a pressure control chamber is formed between the partitioning member and the moving member. The actuator is configured in such a way that the moving member is moved when refrigeration in the discharge chamber is introduced into the pressure control chamber. A support member is fitted on the drive shaft, and contact of the support member with the moving member determines a maximum value of the inclination angle. A thrust bearing is provided between the housing and the drive shaft which supports a thrust force exerted by the support member. The support member includes a cylindrical portion. The position of the cylindrical portion is adjustable along the axis of the drive shaft, and the cylindrical portion projects beyond one end of the drive shaft.

Other aspects and advantages of the invention will become apparent from the following description, taken in conjunction with the accompanying drawings, illustrating by way of example the principles of the invention.

DETAILED DESCRIPTION OF THE EMBODIMENTS

The following will describe a swash plate type variable displacement compressor according to embodiments of the present invention with reference to the accompanying drawings. The compressor according to the embodiment is a swash plate type variable displacement compressor (hereinafter referred to as compressor). The compressor is mounted on a vehicle and forms a part of refrigeration circuit of a vehicle air conditioner.

Figure 1:
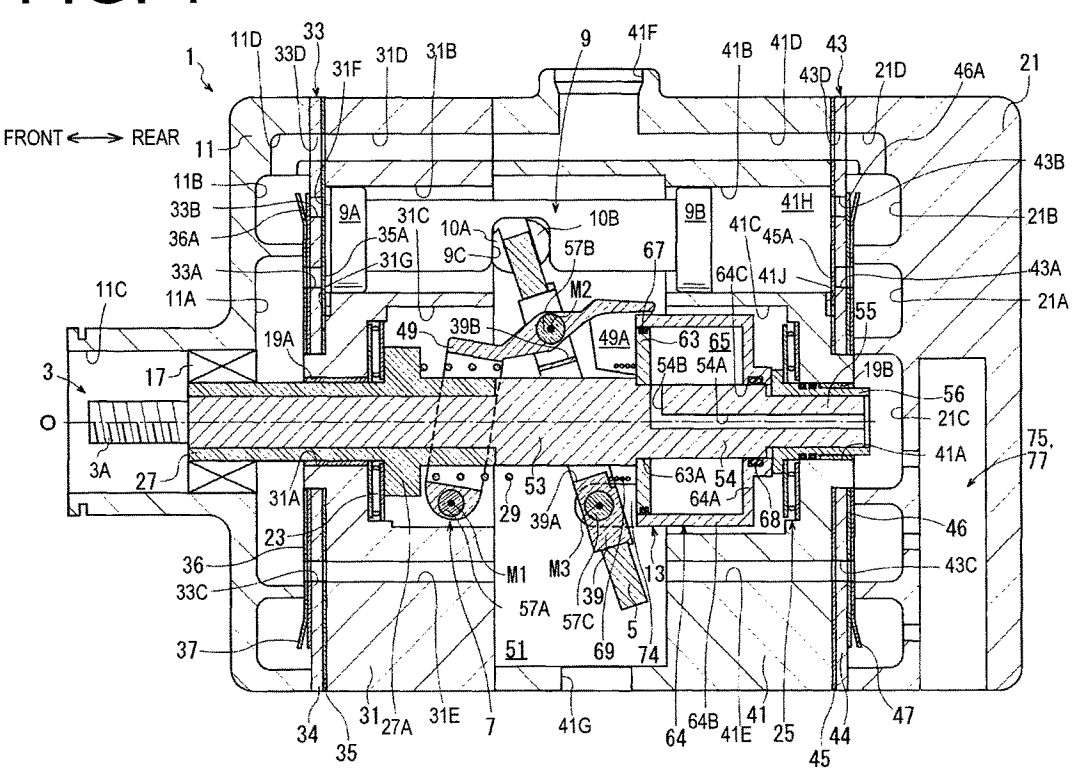
FIG. 1 is a longitudinal cross-sectional view of a compressor according to a first embodiment of the present invention, showing a state of the compressor at its maximum displacement.
Figure 3:
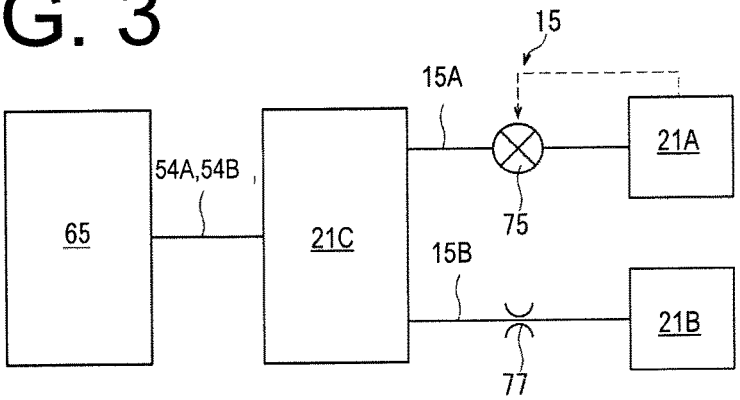
FIG. 3 is a schematic diagram of a control mechanism of the compressor of FIG. 1.

Referring to FIG. 1, the compressor of a first embodiment includes a housing 1, a drive shaft 3, a swash plate 5, a link mechanism 7, a plurality of pistons 9, a plurality of pairs of shoes 10A, 10B and an actuator 13. As shown in FIG. 3, the compressor further includes a control mechanism 15.

As shown in FIG. 1, the housing 1 includes a front housing 11, a rear housing 21 and first and second cylinder blocks 31, 41 that are disposed between the front housing 11 and the rear housing 21.

The front housing 11 has therein a first suction chamber 11A and a first discharge chamber 11B. The first suction chamber 11A has an annular shape and is formed inward of the first discharge chamber 11B. The first discharge chamber 11B has an annular shape. The front housing 11 is formed with a boss 11C projecting forward and having therein a shaft seal device 17.

The front housing 11 has therein a front communication passage 11D. The front communication passage 11D is in communication at the front end thereof with the first discharge chamber 11B and the rear end of the front communication passage 11D is opened at the rear end of the front housing 11.

The rear housing 21 has therein a second suction chamber 21A, a second discharge chamber 21B and a pressure adjusting chamber 21C. The pressure adjusting chamber 21C is formed in the center of the rear housing 21. The second suction chamber 21A has an annular shape and is formed radially outward of the pressure adjusting chamber 21C. The second discharge chamber 21B has an annular shape and is located outward of the second suction chamber 21A. The first and the second suction chambers 11A, 21A correspond to the suction chamber of the present invention. The first and second discharge chambers 11B, 21B correspond to the discharge chamber of the present invention.

The rear housing 21 has therein a rear communication passage 21D. The rear communication passage 21D is in communication at the rear end thereof with the second discharge chamber 21B and the front end of the rear communication passage 21D is opened at the front end of the rear housing 21.

The first cylinder block 31 and the second cylinder block 41 cooperate to form therebetween a swash plate chamber 51. The front housing 11, the first cylinder block 31, the second cylinder block 41 and the rear housing 21 are arranged and fixed together in the direction of the axis O of the drive shaft 3. The front housing 11, the first cylinder block 31 and the second cylinder block 41 correspond to the housing of the presenting invention.

The first cylinder block 31 has therein a first shaft hole 31A through which part of the drive shaft 3 is inserted, a plurality of first cylinder bores 31B, a first recess 31C, a first cylinder block passage 31D and a plurality of first communication passages 31E.

A first radial bearing 19A is provided in the first shaft hole 31A. The first cylinder bores 31B are formed in the first cylinder block 31 around the first shaft hole 31A and located adjacent to the front end of the drive shaft 3. The first recess 31C is formed coaxially and in communication with the first shaft hole 31A and forms a part of the swash plate chamber 51. A first thrust bearing 23 is provided in the first recess 31C at the front end thereof. The front end surface of the first recess 31C is formed in a plane surface extending perpendicularly to the axis O of the drive shaft 3.

The first cylinder block passage 31D is formed in the first cylinder block 31 in communication at the front end thereof with the rear end of the front communication passage 11D in the front housing 11 and the rear end of the first cylinder block passage 31D is opened at the rear end of the first cylinder block 31. Each first communication passage 31E is formed in the first cylinder block 31 in communication at the rear end thereof with the swash plate chamber 51 and the front end of the first communication passage 31E is opened at the front end of the first cylinder block 31.

The second cylinder block 41 has therein a second shaft hole 41A through which part of the drive shaft 3 is inserted, a plurality of second cylinder bores 41B corresponding to the respective first cylinder bores 31B, a second recess 41C, a second cylinder block passage 41D, a plurality of second communication passages 41E, a discharge port 41F that is in communication with the second cylinder block passage 41D and a suction port 41G.

A second radial bearing 19B is press-fitted in the second shaft hole 41A. The second shaft hole 41A is formed coaxially and in communication with the pressure adjusting chamber 21C in the rear housing 21. The second cylinder bores 41B are formed around second shaft hole 41A and located adjacent to the rear end of the drive shaft 3. Each second cylinder bore 41B is paired with its corresponding first cylinder bore 31B. The second recess 41C is formed coaxially and in communication with the second shaft hole 41A. The second recess 41C forms a part of the swash plate chamber 51. A second thrust bearing 25 is provided in the second recess 41C at the rear end thereof. The rear end surface of the second recess 41C is formed in a plane surface extending perpendicularly to the axis O of the drive shaft 3.

The second cylinder block passage 41D is formed in the second cylinder block 41 in communication at the front end thereof with the rear end of the first cylinder block passage 31D and the rear end of the second cylinder block passage 41D is in communication with the rear communication passage 21D at the front end thereof. Each second communication passage 41E is formed in the second cylinder block 41 in communication at the front end thereof with the swash plate chamber 51 and the rear end of the second communication passage 41E is opened at the rear end of the second cylinder block 41. The discharge port 41F is connected to a condenser (not shown) and the suction port 41G is connected to an evaporator (not shown), respectively.

A first valve unit 33 is disposed between the front housing 11 and the first cylinder block 31.

The first valve unit 33 includes a first valve plate 34, a first suction valve plate 35, a first discharge valve plate 36 and a first retainer plate 37. The first valve plate 34, the first discharge valve plate 36 and the first retainer plate 37 have therethrough first suction holes 33A for the respective first cylinder bores 31B. Each first suction hole 33A provides a fluid communication between its corresponding first cylinder bore 31B and the first suction chamber 11A.

The first valve plate 34 and the first suction valve plate 35 have therethrough first discharge holes 33B for the respective first cylinder bores 31B. Each first discharge hole 33B provides a fluid communication between its corresponding first cylinder bore 31B and the first discharge chamber 11B.

Additionally, the first valve unit 33 has therethrough a plurality of first suction communication holes 33C. Each first suction communication hole 33C provides a fluid communication between its corresponding first communication passage 31E and the first suction chamber 11A. The first valve plate 34 and the first suction valve plate 35 have therethrough a first discharge communication hole 33D that provides a fluid communication between the front communication passage 11D and the first cylinder block passage 31D.

The first suction valve plate 35 is located on the rear side of the first valve plate 34 and has a plurality of first suction reed valves 35A to open and close the respective first suction holes 33A. The maximum opening of each first suction reed valve 35A is determined by a first retainer recess 31G formed in the first cylinder block 31. The first discharge valve plate 36 is located on the front side of the first valve plate 34 and has a plurality of first discharge reed valves 36A to open and close the respective first discharge holes 33B. The first retainer plate 37 is located on the front side of the first discharge valve plate 36 and determines the maximum opening of each first discharge reed valve 36A.

A second valve unit 43 is formed between the rear housing 21 and the second cylinder block 41.

The second valve unit 43 includes a second valve plate 44, a second suction valve plate 45, a second discharge valve plate 46 and a second retainer plate 47. The second valve plate 44, the second discharge valve plate 46 and the second retainer plate 47 have therethrough second suction holes 43A for the respective second cylinder bores 41B. Each second suction hole 43A provides a fluid communication between its corresponding second cylinder bore 41B and the second suction chamber 21A.

The second valve plate 44 and the second suction valve plate 45 have therethrough second discharge holes 43B for the respective second cylinder bore 41B. Each second discharge hole 43B provides a fluid communication between its corresponding second cylinder bore 41B and the second discharge chamber 21B.

Additionally, the second valve unit 43 has therethrough a plurality of second suction communication holes 43C. Each second suction communication hole 43C provides a fluid communication between its corresponding second communication passage 41E and the second suction chamber 21A. The second valve plate 44 and the second suction valve plate 45 have therethrough a second discharge communication hole 43D that provides a fluid communication between the second cylinder block passage 41D and the rear communication passage 21D.

The second suction valve plate 45 is located on the front side of the second valve plate 44 and has a plurality of second suction reed valves 45A to open and close the respective second suction hole 43A. The maximum opening of each second suction reed valve 45A is determined by a second retainer recess 41J formed in the second cylinder block 41. The second discharge valve plate 46 is located on the rear side of the second valve plate 44 and has a plurality of second discharge reed valve 46A to open and close the respective second discharge hole 43B by the elastic deformation. The second retainer plate 47 is located on the rear side of the second discharge valve plate 46 and determines the maximum opening of each second discharge reed valve 46A.

The drive shaft 3 is supported in the first and second shaft holes 31A, 41A rotatably about its own axis O. The drive shaft 3 includes a drive shaft body 53, a first small-diameter portion 54 extending rearward from the drive shaft body 53, a second small-diameter portion 55 extending rearward from the first small-diameter portion 54. The drive shaft body 53 drives to rotate the swash plate 5 in conjunction with the link mechanism 7. The drive shaft body 53 has mounted thereon a fixed member 27, the swash plate 5 and the link mechanism 7. The first small-diameter portion 54 is integrally formed with the drive shaft body 53, having a smaller diameter than the drive shaft body 53, and is received in the second recess 41C. The second small-diameter portion 55 is integrally formed with the first small-diameter portion 54 and has a smaller diameter than the first small-diameter portion 54. The first small-diameter portion 54 has at the rear end thereof an annular surface 54S (FIG. 4), extending from the rear end of the outer peripheral surface of the first small-diameter portion 54 to the front end of the outer peripheral surface of the second small-diameter portion 55.

The fixed member 27 is press-fitted on the front end portion of the drive shaft body 53. With the drive shaft 3 rotated about the axis O thereof, the fixed member 27 rotates with the drive shaft 3 in sliding contact with the first radial bearing 19A. The fixed member 27 has a flange 27A that is in contact with the first thrust bearing 23. The first thrust bearing 23 receives a first thrust force acting on the drive shaft 3. A first return spring 29 is fixed at the front end thereof to the fixed member 27. The first return spring 29 extends in the direction of the axis O from the fixed member 27 toward the swash plate chamber 51.

Figure 4:
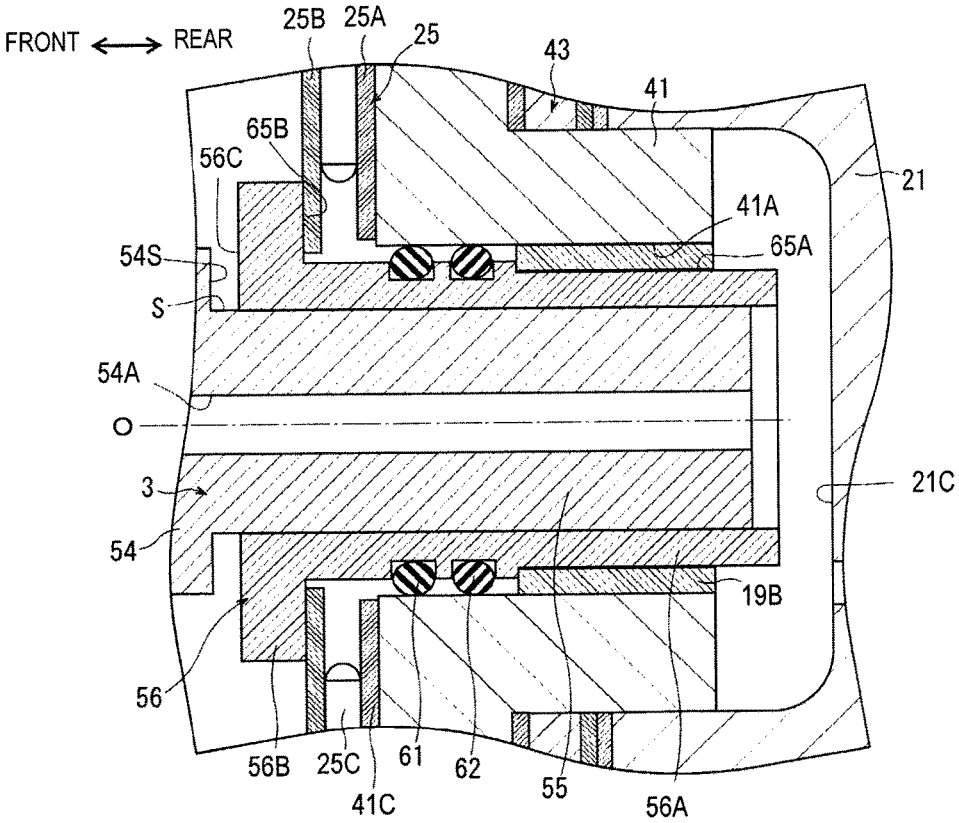
FIG. 4 is partially enlarged fragmentary view of the compressor of FIG. 1, showing the rear end of a drive shaft.

As shown in FIG. 4, a support member 56 that is fitted on the second small-diameter portion 55 of the drive shaft 3 in the second shaft hole 41A of the second cylinder block 41. The support member 56 includes a cylindrical portion 56A and a flange 56B. The cylindrical portion 56A is fitted on the second small-diameter portion 55 of the drive shaft 3 and projects out beyond the rear end surface of the second small-diameter portion 55. In other words, the cylindrical portion 56A projects beyond one end of the drive shaft 3. The position of the cylindrical portion 56A of the support member 56 in the direction of the axis O is adjustable by changing the projection of the cylindrical portion 56A of the support member 56 beyond the rear end surface of the second small-diameter portion 55 into the pressure adjusting chamber 21C.

The cylindrical portion 56A of the support member 56 extends in the direction of the axis O and has a radial bearing surface 65A. The second radial bearing 19B is mounted on the radial bearing surface 65A. With the drive shaft 3 rotated about the axis O of the drive shaft 3, the support member 56 is rotated with the drive shaft 3 in sliding contact with the second radial bearing 19B. Thus, a radial force acting on the rear end side of the second small-diameter portion 55 of the drive shaft 3 is supported by the radial bearing surface 65A via the second radial bearing 19B. In addition, two O-rings 61, 62 are provided in the outer peripheral surface of the cylindrical portion 56A of the support member 56 for sealing between the cylindrical portion 56A of support member 56 and the second cylinder block 41.

The flange 56B is formed extending perpendicularly to the axis O from the cylindrical portion 56A. The flange 56B has at the front end thereof an annular front end surface 56C and at the rear end thereof a thrust bearing surface 65B. The second thrust bearing 25 is fixed to the thrust bearing surface 65B. The thrust bearing surface 65B supports a second thrust force acting on the drive shaft 3 between the thrust bearing surface 65B and the second cylinder block 41. A predetermined clearance S is formed between the front end surface 56C of the flange 56B and the annular surface 54S of the first small-diameter portion 54 of the drive shaft 3.

The second thrust bearing 25 includes a first race 25A that is held in contact with the second cylinder block 41, a second race 25B that is held in contact with the flange 56B of the support member 56, a plurality of rollers 25C that are provided between the first race 25A and the second race 25B and a retainer that retains the rollers 25C between the first and second races 25A, 25B.

As shown in FIG. 1, the swash plate 5 has a shape of an annular plate shape. The swash plate 5 is fixed to a ring plate 39 that is located at the center of the drive shaft 3. The ring plate 39 has an annular plate shape and has therethrough at the center thereof a hole 39A. With the drive shaft 3 inserted through the hole 39A of the ring plate 39, the swash plate 5 is disposed and rotatable in the swash plate chamber 51.

The link mechanism 7 is provided in the swash plate chamber 51 so as to permit changing of the inclination angle of the swash plate 5 with respect to an imaginary plane that extends perpendicularly to the axis O of the swash plate 5. The link mechanism 7 includes a lug arm 49 that has substantially an L-shape. The lug arm 49 is provided between the fixed member 27 and the swash plate 5 in the swash plate chamber 51. The lug arm 49 is fixed at the front end thereof to the fixed member 27 by the first pin 57A. M1 designates a first axis of the first pin 57A and the rear end of the lug arm 49 is supported so as to be swingable about the axis M1 relative to the fixed member 27 and hence to the drive shaft 3.

The lug arm 49 is connected at the rear end thereof to one end of the ring plate 39 by the second pin 57B. The front end of the lug arm 49 is supported so as to be swingable about an axis of the second pin 57B as a second axis M2 with respect to the one end of the ring plate 39, i.e. swash plate 5. The second axis M2 extends perpendicularly to the axis O of the drive shaft 3 and parallel to the first axis M1.

Figure 2:
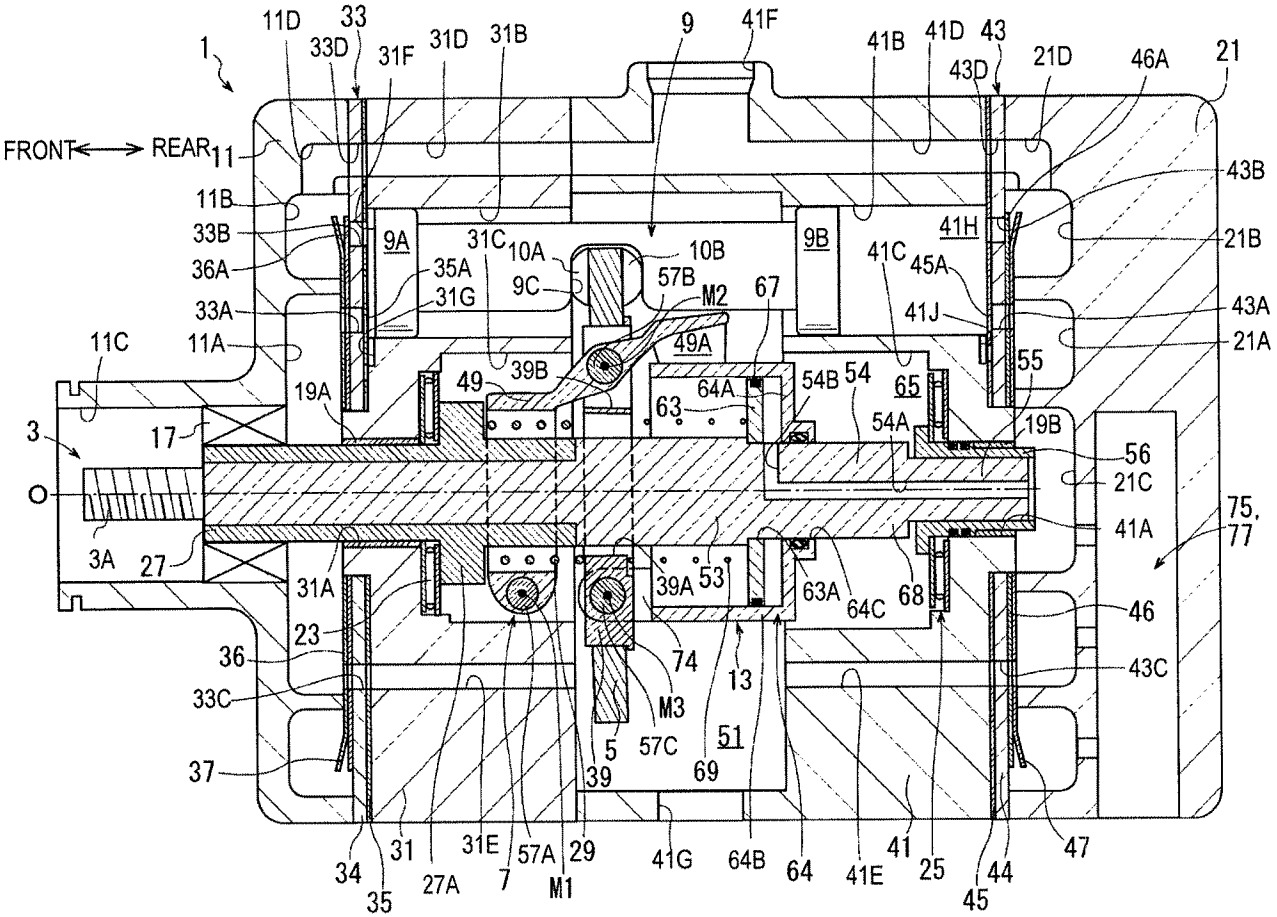
FIG. 2 is a longitudinal cross-sectional view of the compressor of FIG. 1, showing the state of the compressor at its minimum displacement.

As shown in FIG. 2, the lug arm 49 is brought into contact with the flange 27A of the fixed member 27 when the inclination angle of the swash plate 5 becomes minimum. The lug arm 49, the first and second pins 57A, 57B correspond to the link mechanism of the present invention.

As shown in FIG. 1, the lug arm 49 has at the rear end thereof a weight 49A. The weight 49A extends over approximately half the circumference of the actuator 13. The weight 49A may be designed in any suitable shape.

The weight 49A is provided on the rear side of the lug arm 49, that is, on the side of the lug arm 49 that is opposite from the first axis M1. With the lug arm 49 supported by the ring plate 39 at the second pin 57B, the weight 49A is located on the rear side of the ring plate 39, i.e. on the rear side of the swash plate 5. The centrifugal force caused by the rotation of the swash plate 5 about the axis O of the drive shaft acts on the weight 49A at the rear surface of the swash plate 5.

Each piston 9 has at the front end thereof a first head portion 9A and at the rear end thereof a second head portion 9B, respectively. The first head portion 9A of the piston 9 is reciprocally movably received in the first cylinder bore 31B and a first compression chamber 31F is defined in the first cylinder bore 31B between the first head portion 9A and the first valve unit 33.

The second head portion 9B is integrated with its corresponding first head portion 9A and reciprocally movably received in the second cylinder bore 41B. A second compression chamber 41H is defined in the second cylinder bore 41B between the second head portion 9B and the second valve unit 43.

Each piston has therein at the center thereof a piston recess 9C. A pair of hemispherical shoes 10A, 10B is disposed in the piston recess 9C to hold therebetween the swash plate 5. The rotation of the swash plate 5 is converted to the reciprocal motion of the piston 9 by way of the shoes 10A, 10B. The shoes 10A, 10B corresponds to the conversion mechanism of the present invention. The first head portion 9A and the second head portion 9B of the piston 9 are reciprocally movable in the first cylinder bore 31B and the second cylinder bore 41B, respectively, with a stroke length that is variable according to the inclination angle of the swash plate 5.

The actuator 13 is disposed in the swash plate chamber 51 for changing the inclination angle of the swash plate 5. The actuator 13 is located rearward of the swash plate 5 and movable into and out of the second recess 41C. The actuator 13 has a partitioning member 63, a moving member 64 and a pressure control chamber 65 formed between the partitioning member 63 and the moving member 64.

The partitioning member 63 is fixed on the first small-diameter portion 54 of the drive shaft 3. The partitioning member 63 has formed therethrough a hole 63A through which the drive shaft 3 is inserted. An O-ring 67 is provided in the outer periphery of the partitioning member 63 for sealing between the partitioning member 63 and the moving member 64. A second return spring 69 is disposed between the partitioning member 63 and the ring plate 39. More specifically, the second return spring 69 is fixed at the rear end thereof to the partitioning member 63 and the front end of the second return spring 69 is fixed to the other end of the ring plate 39.

The moving member 64 is mounted on the first small-diameter portion 54 of the drive shaft 3 and received in the second recess 41C of the second cylinder block 41 when the swash plate 5 is at its maximum inclination angle position, as shown in FIG. 1. The moving member 64 has a bottomed cylindrical shape and an inner diameter that is substantially the same as the outer diameter of the partitioning member 63. The base portion 64A forms the rear end of the moving member 64 and extends in radial direction. The base portion 64A has a hole 64C through which the first small-diameter portion 54 is inserted. The hole 64C has an O-ring 68 for sealing between the base portion 64A of the moving member 64 and the first small-diameter portion 54 of the drive shaft 3.

The peripheral wall portion 64B is formed extending axially frontward from the outer periphery of base portion 64A. A connecting portion 74 is formed at the front end of the peripheral wall portion 64B. The partitioning member 63 is disposed so as to be surrounded by the peripheral wall portion 64B of the moving member 64. Thus, the control pressure chamber 65 is formed by and between the partitioning member 63 and the moving member 64.

The moving member 64 is movable by the internal pressure of the pressure control chamber 65 formed between the partitioning member 63 and the moving member 64. In other words, the actuator 13 is configured in such a way that the moving member 64 is moved when refrigerant in the discharge chamber 21B is introduced into the pressure control chamber 65. The pressure control chamber 65 is sealed by the O-rings 67, 68.

The moving member 64 is rotatable with the drive shaft 3 and also movable along axis of the drive shaft 3 in sliding contact with the first small-diameter portion 54 of the drive shaft 3. The partitioning member 63 is rotatable with the drive shaft 3, but immovable along the drive shaft 3. The moving member 64 is movable relative to the partitioning member 63 in the direction of the axis O.

The connecting portion 74 of the moving member 64 is connected to the other end of the ring plate 39 by the third pin 57C. Thus, the ring plate 39 and hence swash plate 5 is supported swingably about an axis M3 of the third pin 57C as an acting axis. The axis M3 extends parallel to the axes M1, M2. The moving member 64 is thus connected to the swash plate 5. The moving member 64 is brought into contact with the flange 56B of the support member 56 when the swash plate 5 is tilted to its maximum inclination angle position shown in FIG. 1. In other words, the contact of the support member 56 with the moving member 64 determines the maximum value of the inclination angle.

The second small-diameter portion 55 and the first small-diameter portion 54 of the drive shaft 3 have therein an in-shaft axial passage 54A that extends frontward from the rear end of the drive shaft 3 and an in-shaft radial passage 54B that extends radially from the front end of the axial passage 54A and is opened at the outer peripheral surface of the first small-diameter portion 54. The axial passage 54A is opened at the rear end thereof to the pressure adjusting chamber 21C. The radial passage 54B is in communication with the pressure control chamber 65. Therefore, the pressure control chamber 65 is connected through the radial passage 54B and the axial passage 54A to the pressure adjusting chamber 21C.

The drive shaft 3 has at the front end thereof a threaded portion 3A. The drive shaft 3 is connected to a pulley or a magnetic clutch (neither being shown) through the threaded portion 3A.

As shown in FIG. 3, the control mechanism 15 includes a low pressure passage 15A, a high pressure passage 15B, a control valve 75, an orifice 77, the axial passage 54A and the radial passage 54B.

The low pressure passage 15A is connected at one end thereof to the pressure adjusting chamber 21C and at the other end thereof to the second suction chamber 21A. Consequently, the pressure control chamber 65, the pressure adjusting chamber 21C and the second suction chamber 21A are connected through the low pressure passage 15A, the axial passage 54A and the radial passage 54B. The high pressure passage 15B is connected at one end thereof to the pressure adjusting chamber 21C and at the other end thereof to the second discharge chamber 21B. As a result, the pressure control chamber 65, the pressure adjusting chamber 21C and the second discharge chamber 21B are connected through the high pressure passage 15B, the axial passage 54A and the radial passage 54B. The high pressure passage 15B is provided with the orifice 77.

The control valve 75 is connected in the low pressure passage 15A and controls the opening of the low pressure passage 15A according to the pressure in the second suction chamber 21A.

The compressor is connected at the suction port 41G to the evaporator (not shown) and at the discharge port 41F to the condenser (not shown) by a pipe, respectively. The compressor, the evaporator, an expansion valve and the condenser cooperate to form a refrigeration circuit of a vehicle air conditioner. The evaporator, the expansion valve, the condenser and the pipes are omitted from the illustration in the drawings.

In the compressor having the above-described configuration, the rotation of the swash plate 5 driven by the drive shaft 3 causes each piston 9 to reciprocate in its corresponding first and second cylinder bores 31B, 41B. Accordingly, the volume of the first and second compression chambers 31F, 41F is changed and compression of refrigerant gas is accomplished. In accordance with the reciprocating movement of each piston 9, suction phase during which refrigerant gas is introduced into the first and second compression chamber 31F, 41H, compression phase during in which refrigerant is compressed in the first and second compression chambers 31F, 41H and discharge phase during which the compressed refrigerant gas is discharged out from the first and second compression chambers 31F, 41H take place repeatedly.

In the control mechanism 15 of the compressor, when the opening of the low pressure passage 15A is increased by the control valve 75, the pressures in the pressure adjusting chamber 21C and the control pressure chamber 65 become substantially the same as the pressure in the second suction chamber 21A. As a result, the moving member 64 of the actuator 13 is moved frontward or toward the lug arm 49, which causes the swash plate 5 to swing in clockwise direction about the axis M3. In addition, the lug arm 49 swings in counterclockwise direction about the second axis M2 and in counterclockwise direction about the first axis M1, which causes the lug arm 49 to move toward the flange 27A of the fixed member 27. Consequently, the swash plate 5 swings about the second axis M2 in the direction that reduces the inclination angle of the swash plate 5, so that the stroke length of each piston 9 is reduced. Therefore, the discharge volume per rotation of the drive shaft 3 and hence the displacement of the compressor is reduced.

When the control valve 75 is closed and decreases the opening of the low pressure passage 15A, on the other hand, the pressure in the pressure adjusting chamber 21C is increased and the pressure in the pressure control chamber 65 is increased, accordingly. The moving member 64 of the actuator is moved rearward away from the lug arm 49. The inclination angle of the swash plate 5 is increased and the stroke length of each piston 9 is increased, accordingly, so that the discharge volume per rotation of the drive shaft 3 and hence the displacement of the compressor is increased. In other words, the control mechanism 15 controls the actuator 13.

In the mass production of the above-described compressor, adjusting the space S between the front end surface 56C of the flange 56B of the support member 56 and the annular surface 54S of the first small-diameter portion 54 of the drive shaft 3 when fastening the first and second cylinder blocks 31, 41, the first and second thrust bearings 23, 25 and other parts in the axial direction of the compressor for assembling permits the second thrust bearing 25 provided between the second cylinder block 41 and the first small-diameter portion 54 of the drive shaft 3 to support the thrust force through the support member 56 without performing a strict thrust allowance control. Thus, the compressor is free from deformation of the first and second cylinder blocks 31, 41 and the first and second thrust bearings 23, 25, increased torque required for the drive shaft 3 and shortened life of the first and second thrust bearings 23, 25 and, therefore, the production yield of the compressor is improved. In addition, the cost of some parts may be reduced because strict dimensional control is not needed for such parts. Axial adjustment of the cylindrical portion 56A of the support member 56 may be accomplished easily by pushing the projection of the cylindrical portion 56A beyond the rear end surface of the second small-diameter portion 55, which facilitates the assembling of the compressor.

Furthermore, the structure of the compressor in which the maximum inclination angle of the swash plate 5 is determined by the contact of the flange 56B of the support member 56 with the moving member 64 helps to minimize the quality variation of compressors without practicing strict dimensional control for parts.

Therefore, the present embodiment helps to reduce the manufacturing cost of the compressor.

Second Embodiment

Figure 5:
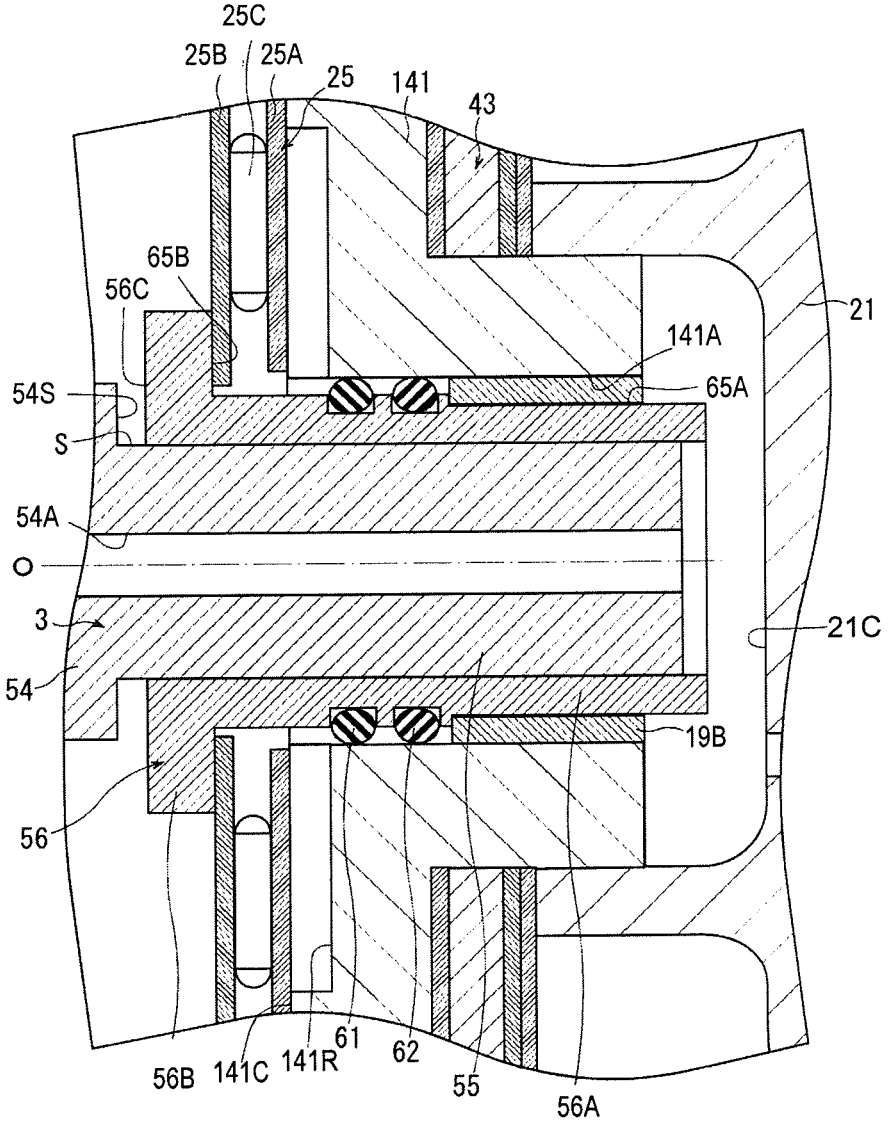
FIG. 5 is a partially enlarged fragmentary view of a compressor according to a second embodiment of the present invention, showing the rear end of a drive shaft.

The following will describe a compressor according to a second embodiment of the present invention with reference to FIG. 5. Numeral 141 designates a second cylinder block of the compressor of the second embodiment having therein an annular groove 141R formed adjacent to the second shaft hole 141A of the second recess 141C in the second cylinder block 141. The annular groove 141R is formed large enough to extend radially beyond the outer periphery of the rollers 25C of the second thrust bearing 25 thereby to allow inner peripheral part of the second thrust bearing 25 to be bent rearward.

The second thrust bearing 25 is held in contact in the outer peripheral part of the first race 25A thereof with the bottom of the second recess 141C. The thrust bearing surface 65B of the flange 56B of the support member 65 is held in contact with the inner peripheral part of the second race 25B. The rest of the configuration of the compressor according to the second embodiment is substantially the same as the first embodiment.

In the compressor of the second embodiment, the first race 25A and the second race 25B of the thrust bearing 25 are bent when the front housing 11, the first cylinder block 31, the second cylinder block 141 and the rear housing 21 are fastened together in the axial direction of the compressor. In other words, the thrust bearing 25 is pressed at the outer peripheral part of the first race 25A thereof against the second cylinder block 141 and at the inner peripheral part of the second race 25B thereof against the thrust bearing surface 65B, respectively, by the fastening force transmitted from the thrust bearing surface 65B of the support member 56. Therefore, the first race 25A and the second race 25B of the thrust bearing 25 are bent so as to tilt with respect to an imaginary plane extending perpendicularly to the axis O of the drive shaft 3, so that the thrust fastening allowance is absorbed. The compressor of the second embodiment provides the same effects as the compressor of the first embodiment.

Third Embodiment

Figure 6:
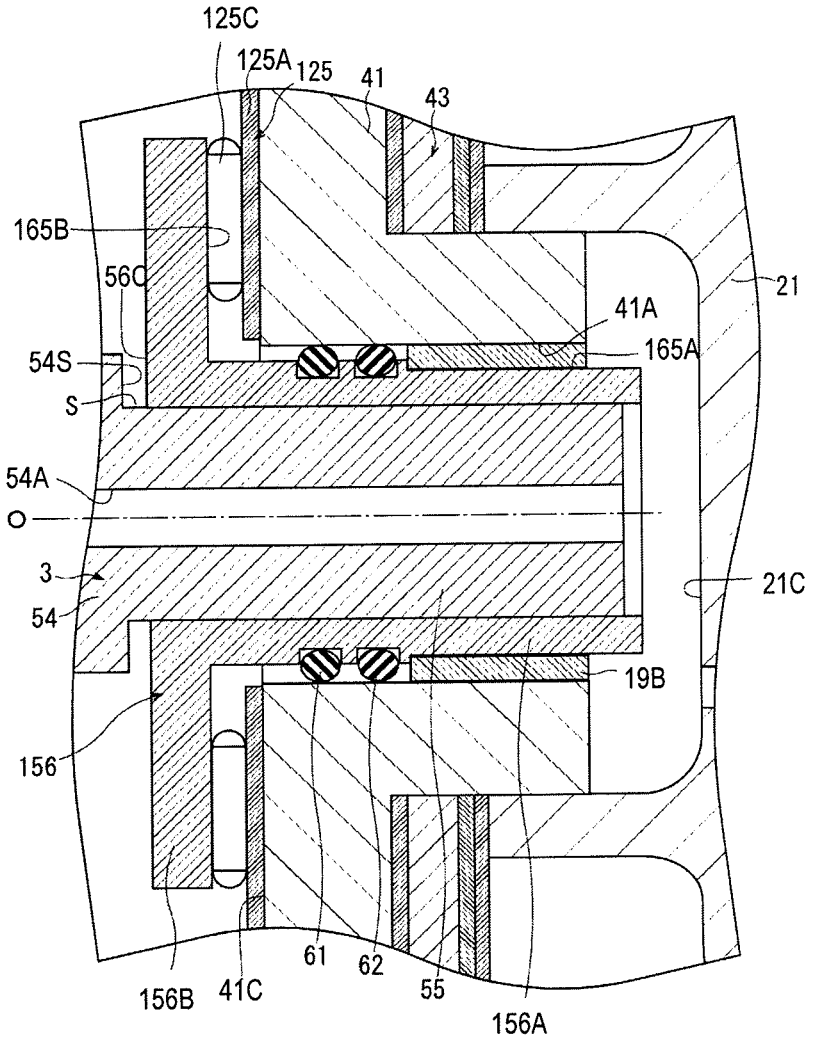
FIG. 6 is a partially enlarged fragmentary view of a compressor according to a third embodiment of the present invention, showing the state of the compressor with second race removed.

The following will describe a compressor according to a third embodiment of the present invention with reference to FIG. 6. The compressor of the third embodiment has a second thrust bearing 125 that includes a first race 125A, a plurality of rollers 125C and the retainer (not shown). The first race 125A is held in contact with the second cylinder block 41.

The compressor of the third embodiment has a support member 156 including a cylindrical portion 156A that is fitted on the second small-diameter portion 55 and a flange 156B having a diameter that is greater than the flange 56B of the support member 56. The large-diameter flange 156B extends perpendicularly to the axis O of the drive shaft 3 from the cylindrical portion 156A and has a thrust bearing surface 165B on the rear side thereof. The rollers 125C are located between the large-diameter flange 156B and the first race 125A. The large-diameter flange 156B has a diameter large enough to cover the outer periphery of the rollers 125C. In other words, the thrust bearing surface 165B of the large-diameter flange 156B serves as a second race such as 25B of the first embodiment.

In the compressor of the third embodiment, the thrust force from the thrust bearing surface 165B of the large diameter flange 156B is directly transmitted to the rollers 125C, so that the second race 25B as in the first embodiment need not be provided in the second thrust bearing 125 and the number of parts for the compressor may be reduced, accordingly. As a result, the production cost of the compressor may be reduced. The compressor according to the third embodiment offers substantially the same effects as the compressor of the first embodiment.

The Fourth Embodiment

Figure 7:
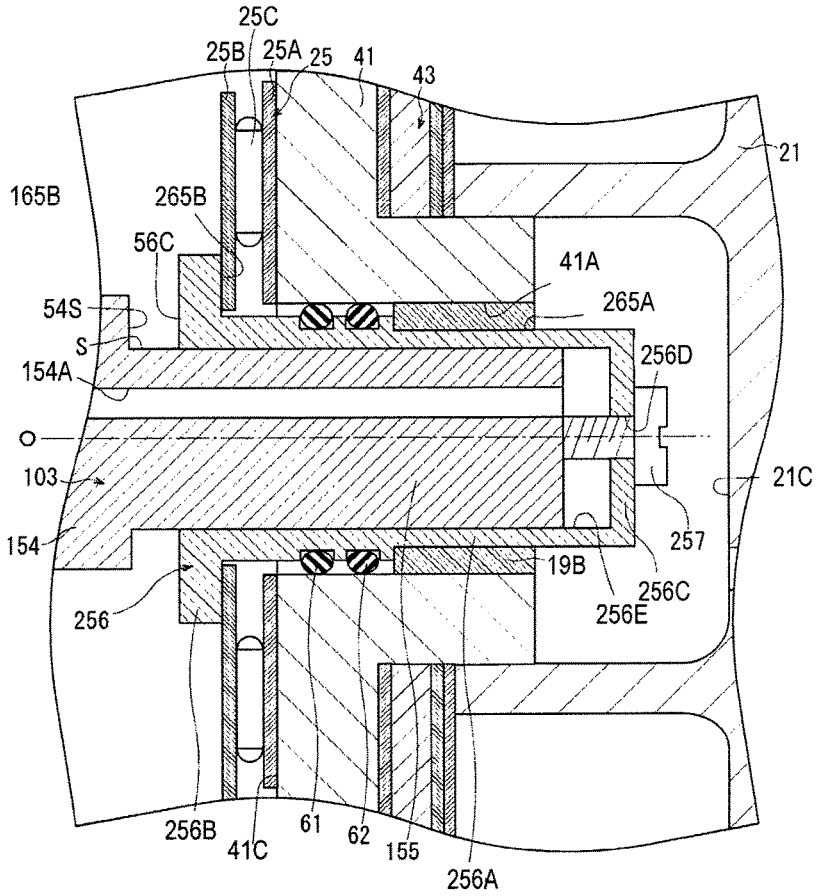
FIG. 7 is a partially enlarged fragmentary view of a compressor according to a fourth embodiment of the present invention, showing an adjustment of axial position of a support member by using a screw.

The following will describe a compressor according to a fourth embodiment of the present invention with reference to FIG. 7. The compressor of the fourth embodiment has a support member 256 of a bottomed cylindrical shape. The support member 256 includes a cylindrical portion 256A and a bottom portion 256C. The bottom portion 256C extends from the rear end of the cylindrical portion 256A toward the axis O of the drive shaft 3.

The bottom portion 256C has at the center thereof a hole 256D through which an adjusting screw 257 is screwed. The hole 256D is coaxially with the axis O of the drive shaft 3. An adjustment space 256E is formed between the bottom portion 256C of the support member 256 and the rear end of the second small-diameter portion 155 of the drive shaft 103, and the adjustment space 256E is in communication with the pressure adjusting chamber 21C via the hole 256D.

The drive shaft 103 of the compressor of the fourth embodiment includes a first small-diameter portion 154 and a second small-diameter portion 155. An in-shaft axial passage 154A extends in the second small-diameter portion 155 and the first small-diameter portion 154 frontward from the rear end of the drive shaft 103. The in-shaft axial passage 154A is formed with its axis offset from the axis O, so that the in-shaft axial passage 154A rotates around the axis O of the drive shaft 103. The rest of the configuration of the fourth embodiment is substantially the same as the first embodiment.

In mounting the support member 256 on the second small-diameter portion 155 of the drive shaft 103, the axial position of the support member 256 relative to the drive shaft 3 is easily adjustable by screwing in or out the adjusting screw 257. In other words, the adjusting screw 257 is inserted through the bottom portion 256C to adjust the projection of the support member 256 beyond the one end of the drive shaft 3. The thrust allowance of the compressor may be thus controlled.

The adjusting screw 257 is removed while the swash plate type variable displacement compressor is being assembled. The control pressure chamber 65 and the pressure adjusting chamber 21C are in communication with each other via the hole 256D, the adjustment space 256E, the axial passage 154A and the radial passage 54B shown in FIGS. 1 and 2. The compressor of the fourth embodiment provides the same effects as the compressor of the first embodiment.

The present invention is not limited to the above-described first, second, third and fourth embodiments, but it may be modified in various manners within the scope of the present invention.

The present invention is applicable to an air conditioner.

What is claimed is:

1. A swash plate type variable displacement compressor comprising:

a housing having a suction chamber, a discharge chamber, and a swash plate chamber;

a cylinder block having therein a plurality of cylinder bores;

a drive shaft rotatably supported in the housing;

a swash plate disposed in the swash plate chamber and rotatable with the drive shaft;

a link provided between the drive shaft and the swash plate that permits a change in an inclination angle of the swash plate to an imaginary plane extending perpendicularly to an axis of the drive shaft;

a plurality of pistons reciprocally movably received in the respective cylinder bores;

a converter that converts the rotation of the swash plate to the reciprocal motion of the pistons with a stroke length that is variable according to the inclination angle of swash plate;

an actuator disposed in the swash plate chamber to change the inclination angle; and a controller that controls the actuator, wherein the actuator includes a partitioning member mounted on the drive shaft, a moving member connected to the swash plate, mounted on the drive shaft, and movable along the axis of the drive shaft, and a pressure control chamber provided between the partitioning member and the moving member, and wherein the actuator is configured in such a way that the moving member is moved when refrigerant in the discharge chamber is introduced into the pressure control chamber, wherein a support member is fitted on the drive shaft, wherein contact of the support member with the moving member determines a maximum value of the inclination angle, wherein a thrust bearing is provided between the cylinder block and the drive shaft, the thrust bearing is further provided between the support member and the cylinder block to support a thrust force through the support member, wherein the support member has a cylindrical portion that is fitted on the drive shaft, wherein a position of the cylindrical portion is adjustable along the axis of the drive shaft, and wherein the cylindrical portion projects beyond one end of the drive shaft.

2. The swash plate type variable displacement compressor according to claim 1, wherein the support member further includes a bottom portion that extends from one end of the cylindrical portion toward the axis of the drive shaft, and wherein an adjusting screw is inserted through the bottom portion to adjust the projection of the support member beyond the one end of the drive shaft.

3. The swash plate type variable displacement compressor according to claim 2, wherein the adjusting screw is removed while the swash plate type variable displacement compressor is being assembled.

* * * * *